US011624200B2

(12) United States Patent
Aronow et al.

(10) Patent No.: US 11,624,200 B2
(45) Date of Patent: Apr. 11, 2023

(54) GROUND MOUNTING SYSTEMS AND METHODS FOR INTERACTIVE PROPERTY ADVERTISING DEVICES

(71) Applicant: Darren Aronow, Jericho, NY (US)

(72) Inventors: Darren Aronow, Jericho, NY (US); Max Aronow, Frederick, MD (US)

( * ) Notice: Subject to any disclaimer, the term of this patent is extended or adjusted under 35 U.S.C. 154(b) by 12 days.

(21) Appl. No.: 17/114,918

(22) Filed: Dec. 8, 2020

(65) Prior Publication Data

US 2021/0198915 A1 Jul. 1, 2021

Related U.S. Application Data

(60) Provisional application No. 62/954,076, filed on Dec. 27, 2019.

(51) Int. Cl.

| | |
|---|---|
| ***E04H 12/22*** | (2006.01) |
| ***G09F 7/18*** | (2006.01) |
| ***G09F 15/00*** | (2006.01) |

(52) U.S. Cl.

CPC ..... *E04H 12/2223* (2013.01); *E04H 12/223* (2013.01); *G09F 7/18* (2013.01); *G09F 15/005* (2013.01); *G09F 15/0037* (2013.01); *G09F 2007/1808* (2013.01); *G09F 2007/1856* (2013.01)

(58) Field of Classification Search

CPC ..... E04H 12/2223; E04H 12/223

See application file for complete search history.

(56) References Cited

U.S. PATENT DOCUMENTS

| | | | | |
|---|---|---|---|---|
| 5,065,975 | A * | 11/1991 | Giles | A47G 29/1216 248/156 |
| 6,298,611 | B1 * | 10/2001 | Oliver | E02D 5/801 52/157 |
| 6,334,281 | B1 * | 1/2002 | Oliver | E02D 5/801 52/157 |
| 7,438,273 | B2 * | 10/2008 | Tota | E04H 12/2253 248/530 |
| 7,883,070 | B2 * | 2/2011 | Schroeder | G09F 7/18 248/156 |
| 8,839,572 | B2 * | 9/2014 | Lee | E04H 12/2269 52/156 |
| 9,145,706 | B2 * | 9/2015 | Lee | E04H 17/263 |
| 10,008,134 | B2 * | 6/2018 | Pura | E04H 12/2223 |
| 10,982,404 | B1 * | 4/2021 | Jones | E02D 5/80 |
| 11,085,199 | B2 * | 8/2021 | Writesman | E01F 9/635 |
| 11,154,152 | B2 * | 10/2021 | Hammar | A47G 29/1216 |
| 2004/0163336 | A1 * | 8/2004 | Hsu | E04H 12/2223 52/157 |
| 2007/0200046 | A1 * | 8/2007 | Tota | E04H 12/2223 248/545 |
| 2008/0230674 | A1 * | 9/2008 | Schroeder | E04H 12/2292 248/545 |

(Continued)

*Primary Examiner* — Rodney Mintz

(74) *Attorney, Agent, or Firm* — Carter, DeLuca & Farrell LLP

(57) ABSTRACT

A ground mounting system for supporting a post includes a sleeve configured to receive the post therein, a plate secured to the sleeve and defining at least one slot therethrough, an auger positioned to extend from the plate to secure the plate to the ground, and at least one stake receivable within the at least one slot to facilitate securement of the plate to the ground.

14 Claims, 14 Drawing Sheets

(56) References Cited

U.S. PATENT DOCUMENTS

| | | | | |
|---|---|---|---|---|
| 2014/0020310 | A1* | 1/2014 | Lee | E04H 17/263 52/157 |
| 2014/0352235 | A1* | 12/2014 | Lee | E02D 7/22 52/157 |
| 2018/0137790 | A1* | 5/2018 | Pura | G09F 7/22 |
| 2019/0063102 | A1* | 2/2019 | Writesman | E04H 12/2215 |
| 2020/0245799 | A1* | 8/2020 | Hammar | A47G 29/1216 |
| 2021/0108387 | A1* | 4/2021 | Jones | E04H 12/2215 |
| 2021/0198916 | A1* | 7/2021 | Aronow | E04H 12/223 |

* cited by examiner

GROUND MOUNTING SYSTEMS AND METHODS FOR INTERACTIVE PROPERTY ADVERTISING DEVICES

CROSS REFERENCE TO RELATED APPLICATION

This application claims the benefit of and priority to U.S. Provisional Patent Application Ser. No. 62/954,076, filed on Dec. 27, 2019, the entire contents of which are incorporated by reference herein.

TECHNICAL FIELD

The present disclosure relates to systems and methods for interactive property advertising, including systems and methods for ground mounting interactive property advertising devices.

SUMMARY

Embodiments of the present disclosure are described in detail with reference to the drawings wherein like reference numerals identify similar or identical elements.

An aspect of the present disclosure provides a system for interactive property advertising, the system including: a headpiece, a motion detector apparatus, a rechargeable battery, and a post. The headpiece includes a solar charging system and a display configured to display advertising. The motion detector apparatus is configured to detect a user based on motion and contact a person associated with the property from a predetermined contact list. The solar charging system is configured to charge the battery.

In another aspect of the disclosure, the headpiece further includes a barcode configured for a user to scan using a user device to supply real-time information to the user device.

In further aspects of the disclosure, the post may further include a barcode configured for a user to scan using a user device to supply real-time information to the user device.

In another aspect of the disclosure, the display may further include a touch screen.

In further aspects of the disclosure, the display may further include an illumination source.

In another aspect of the disclosure, the display may further include at least one of: a semicircular shape, a square shape, or a rectangular shape.

In further aspects of the disclosure, the display may be configured to attach to the headpiece by springs.

In another aspect of the disclosure, the headpiece may be weatherproof.

In further aspects of the disclosure, the motion detector apparatus may include a camera, a microphone, a button, and a wireless communication system.

In another aspect of the disclosure, the system may further include a midpiece. The midpiece may include a display.

In further aspects of the disclosure, the post may include a single rectangular post, a dual rectangular post, a cylindrical post, a dual cylindrical post, or an arched post.

In another aspect of the disclosure, the system may further include a ground mounting apparatus. The ground mounting apparatus may include a sleeve configured to support the post, a plate including a surface defining at least one slot, an auger configured for securement to the ground, and at least one stake disposed in the at least one slot, the at least one stake configured to further fix the ground mounting apparatus in position.

An aspect of the present disclosure provides a ground mounting system for supporting a post including a sleeve configured to receive the post therein, a plate secured to the sleeve and defining at least one slot therethrough, an auger positioned to extend from the plate to secure the plate to the ground, and at least one stake receivable within the at least one slot to facilitate securement of the plate to the ground.

In further aspects of the disclosure, the stake may include a retaining finger configured for retaining the stake within the at least one slot, a leg extending from the retaining finger, and a piercing edge extending from the leg and configured to pierce or cut the earth while driving the stake into the earth.

In another aspect of the disclosure, the retaining finger may include a hook.

In further aspects of the disclosure, the auger may include a helical arrangement of a coil and a pointed tip. Turns of the coil may be regularly spaced about the auger.

In another aspect of the disclosure, the sleeve may include a sidewall that defines a transverse passage configured for receipt of a tool for turning the ground mounting system to drive the auger into the ground.

In further aspects of the disclosure, the sleeve may include an inner surface defining a passage therethrough.

In another aspect of the disclosure, the at least one slot of the plate may extend longitudinally relative to the sleeve.

In further aspects of the disclosure, the auger may include a drive member configured for transferring rotational force to the auger.

An aspect of the present disclosure provides a method for installing a ground mounting system, including: aligning an auger of the ground mounting system transverse to the ground; receiving a tool for turning the ground mounting system to drive the auger into the ground, in a sidewall of a sleeve of the ground mounting system, the sidewall defining a transverse passage for receipt of the tool; transferring rotational force to the auger by the tool; receiving at least one stake within at least one slot of a plate of the ground mounting system; and receiving a post within a sleeve configured to for supporting the post.

In further aspects of the disclosure, the method may further include positioning a plurality of stakes within a plurality of slots of the plate of the ground mounting system to facilitate securement of the plate to the ground.

In another aspect of the disclosure, the method may further include piercing the ground with at least one pointed tip of the at least one stake.

In further aspects of the disclosure, rotating the tool may include rotating at least one of clockwise or counter-clockwise.

In another aspect of the disclosure, the method may further include removing the tool received in the sidewall before positioning the post within the sleeve.

In another aspect of the disclosure, the method may further include inserting hardware through the transverse passage into the post to fix the post within the sleeve.

In another aspect of the disclosure, the method may further include orienting the sleeve in a perpendicular orientation.

In another aspect of the disclosure, the method may further include arranging the plurality of stakes around the post in a radial arrangement.

Another aspect of the present disclosure provides a method for interactive property advertising including: detecting motion, by a motion detector apparatus, of a user having a mobile device; displaying, by a touch screen display, an advertisement associated with the property, based on the detected motion; transmitting information associated with the property, based on a barcode, to the user device; and connecting for two way communication, via a wireless network, a person from a predetermined contact list, the person associated with the property, based on the detected motion.

Further details and aspects of exemplary embodiments of the present disclosure are described in more detail below with reference to the appended figures.

BRIEF DESCRIPTION OF THE DRAWINGS

A better understanding of the features and advantages of the disclosed technology will be obtained by reference to the following detailed description that sets forth illustrative embodiments, in which the principles of the technology are utilized, and the accompanying drawings of which.

Figure 1:
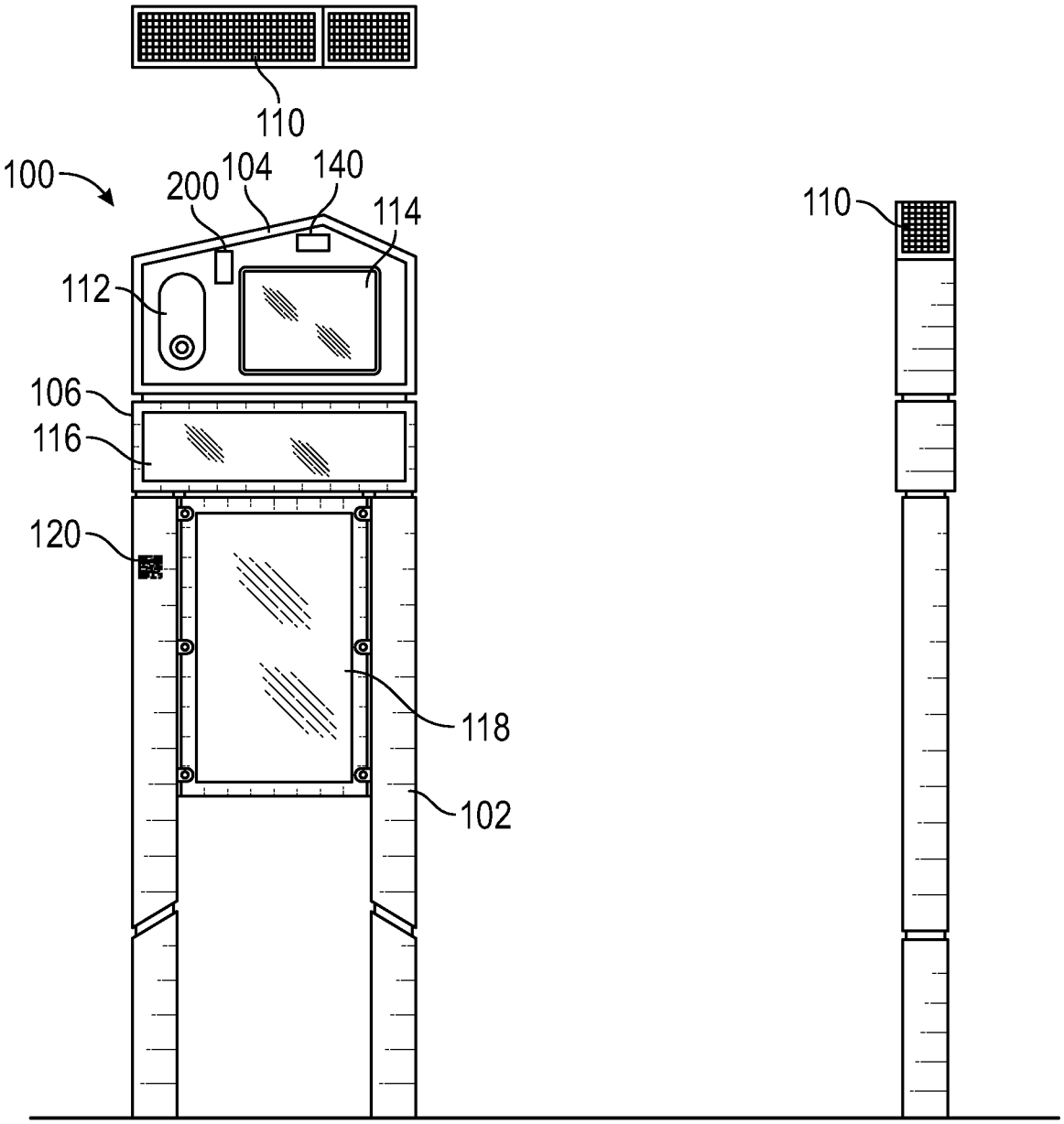
FIG. 1 is a side view of a system for interactive display of property advertising, in accordance with the present disclosure.

Further details and aspects of various embodiments of the present disclosure are described in more detail below with reference to the appended figures.

DETAILED DESCRIPTION

This disclosure relates to systems and methods for interactive property advertising.

Although the present disclosure will be described in terms of specific embodiments, it will be readily apparent to those skilled in this art that various modifications, rearrangements, and substitutions may be made without departing from the spirit of the present disclosure. The scope of the present disclosure is defined by the claims appended hereto.

For purposes of promoting an understanding of the principles of the present disclosure, reference will now be made to exemplary embodiments illustrated in the drawings, and specific language will be used to describe the same. It will nevertheless be understood that no limitation of the scope of the present disclosure is thereby intended. Any alterations and further modifications of the inventive features illustrated herein, and any additional applications of the principles of the present disclosure as illustrated herein, which would occur to one skilled in the relevant art and having possession of this disclosure, are to be considered within the scope of the present disclosure.

With reference to FIGS. 1 and 2-6, various systems 100 for interactive display of property advertising are shown. Each system 100 includes a headpiece 104, 304, 404, 504, a midpiece 106, one or more posts 102, a rechargeable battery 140, and a solar charging system 110.

The headpiece 104, 304, 404, 504 may be aluminum, plastic, and/or other suitable weatherproof material that will house the control unit 200, a motion-based system, a display 114 (e.g., a touch screen tablet computer or an insert sign display with the illuminated exterior). The display 114 will allow "leads" to be created by the users as they approach the sign for usage. In various embodiments, the display 114 is configured to attach to the headpiece 104, 304, 404, 504 by one or more springs. The headpiece 104, 304, 404, 504 may include a bar code 120 so that when someone scans the bar code 120, it will offer the relay of information to their computer or mobile phone and the collection and disbursement of data with real-time responses. The headpiece 104, 304, 404, 504 is disposed of on the midpiece 106. The headpiece 104, 304, 404, 504 may be any suitable geometric configuration (e.g., trapezoidal, round, square, rectangle, oblong, etc.).

The midpiece 106 is disposed on the post 102. In various embodiments, spring attachments, and/or clamps may be used to mount the midpiece 106 to the post 102 and or to the headpiece 104. The midpiece 106 may include a second display unit 116. The wiring required to attach the control unit 200 to the second display unit 116 may be disposed within the midpiece 106. The second display unit 116 may include a digital display that may include a variety of images that may flash every few seconds to another image. The second display unit 116 may display a variety of videos, pictures, and/or wording with a variety of messages. In various embodiments, the midpiece 106 may display a barcode such that when someone scans the bar code 120, it will offer the relay of information to their computer or mobile phone and the collection and disbursement of data, with real-time responses. In various embodiments, additional information may be relayed via SMS, MMS, WAP, Push, email, internet browsing, and/or video streaming.

In various embodiments, the post 102 may be any suitable geometric configuration (e.g., cylindrical, rectangular, etc.) and may hold an insert system to slide in attachments or an automated computer display to be controlled from the mobile phone, laptop computer, or other computing device. The internal system of the post may be equipped to house the computer wiring and components necessary to connect the various pieces and to coordinate the multi-functions of the apparatus. The post may be constructed of aluminum, or any other suitable material for supporting the system. In various embodiments, the post 102 may include a single rectangular post, a dual rectangular post, a cylindrical post, a dual cylindrical post, and/or an arched post.

In various embodiments, the bottom of the post 102 may connect to the sleeve of a floor plate which may include an internal device to drive a connection rod, and an expanding base auger with the disc-shaped spiral body into the ground to rotate and apply downward force while displacing soil and thereby to support the weight of the sign. The bottom of the post 102 may include a ground mounting system for mounting the system 100 to the ground. In various embodiments, the post may include a third display unit 118 (see, e.g., FIG. 1).

Figure 7:
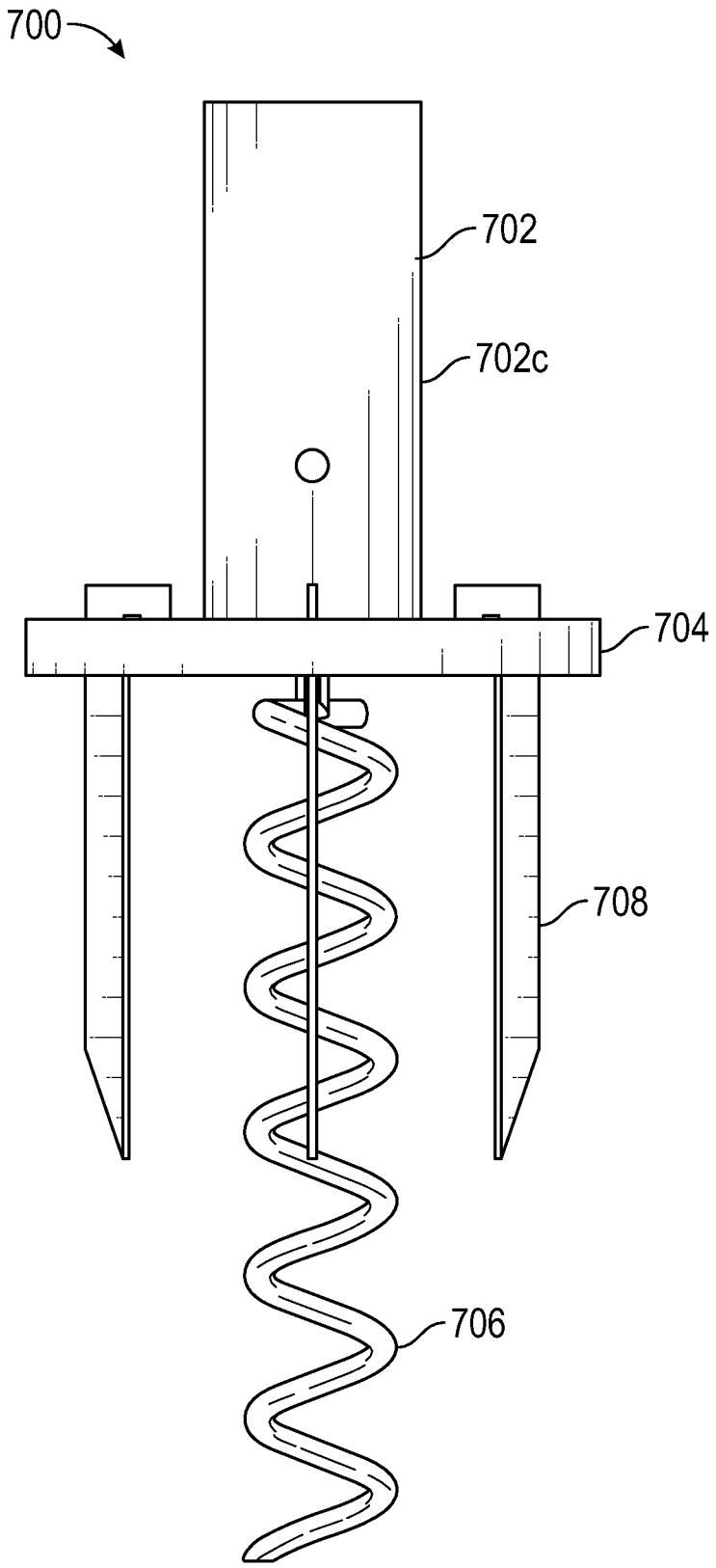
FIGS. 7-12 are views of a ground mounting apparatus for the interactive display of FIG. 1.
Figure 8:
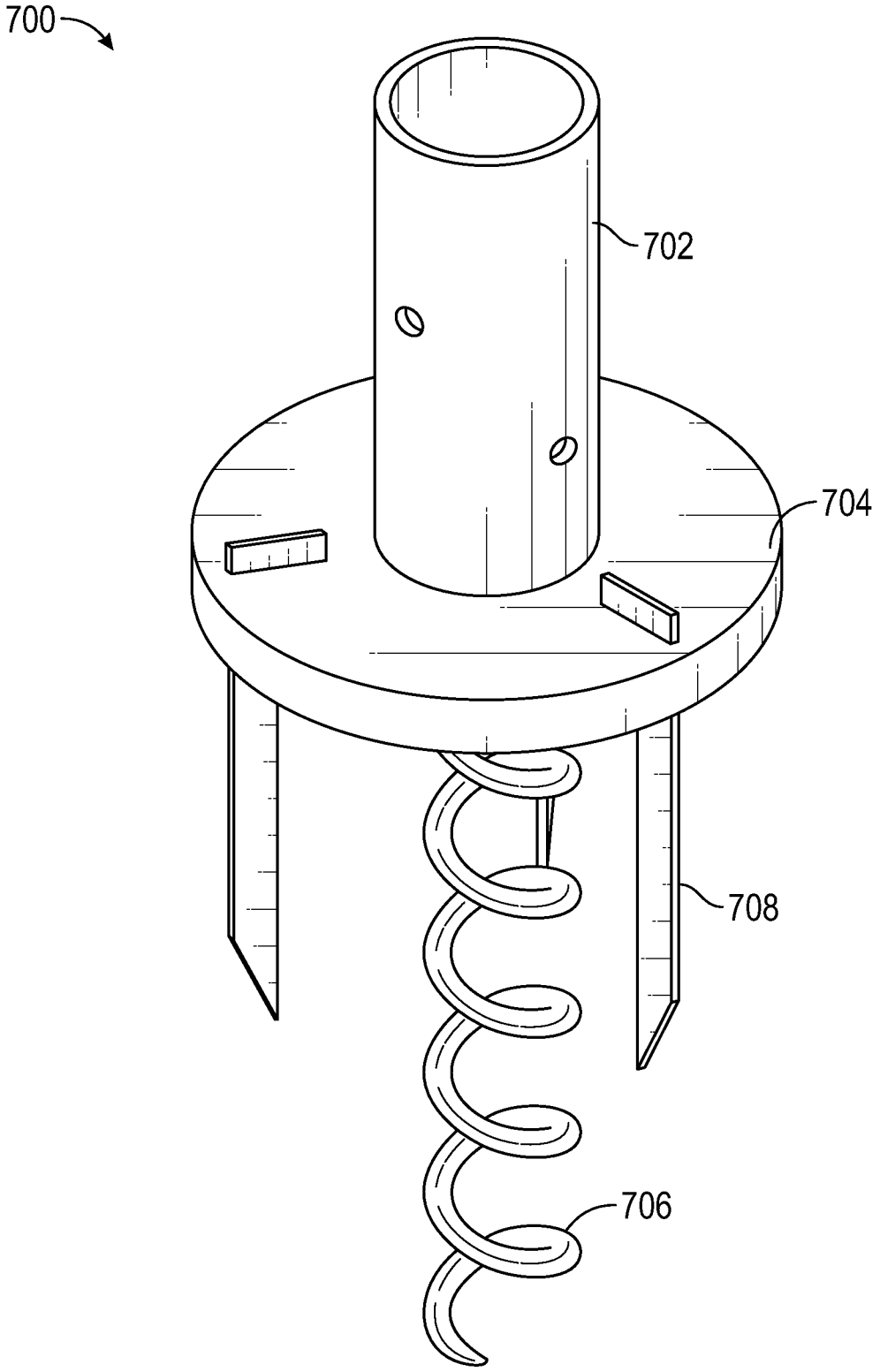
Figure 9:
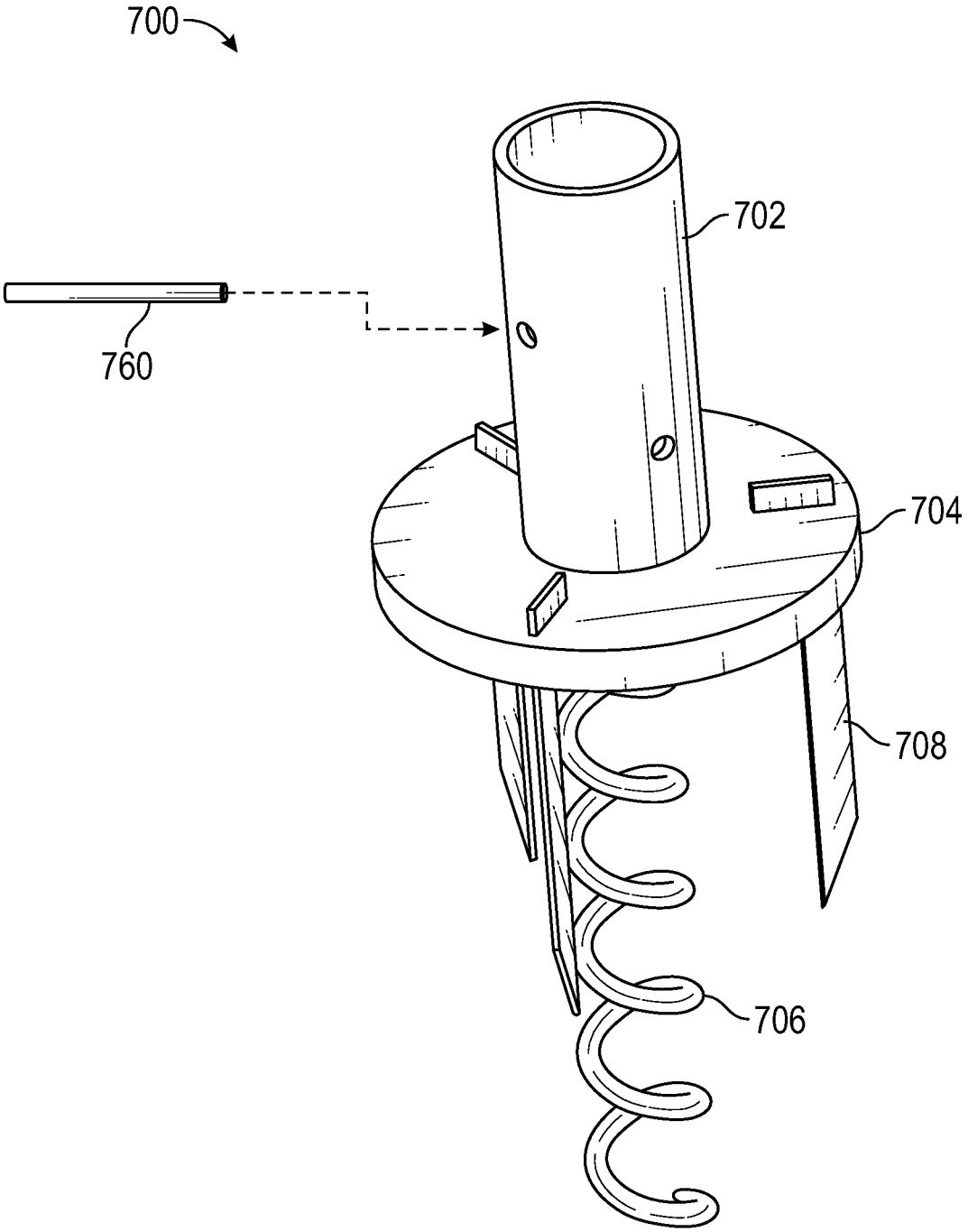

In various embodiments, the rechargeable battery 140 may be disposed of internally or externally. In various embodiments, the rechargeable battery 140 may be disposed in the headpiece 104, the midpiece 106 and/or on the floor plate (FIG. 7).

In various embodiments, the system 100 may include a motion-based automated camera system 112 and an alert system that can communicate with an external system such as a mobile telephone device or laptop computer. In various embodiments, system 100 may include lights or LEDs to illuminate the signs. For example, the sign may be illuminated in the evening. In various embodiments, the system may illuminate the signs based on detecting motion.

The computer system may include a memory storage device that can be accessed with flashcards, laptop computers, PDAs, cellphones or other user devices. In various embodiments, the system is configured to store in memory data relating to the property for sale. For example, the data may include videos or pictures of the property, the listing agent's contact info, the price of the property, etc.

In various embodiments, the system includes a wireless communication system (e.g., WIFI, Bluetooth, NFC, and/or cellular data) configured to transmit the stored data wirelessly to another electronics device where information can be reviewed.

In various embodiments, an external computer and/or mobile application device may communicate with the system 100 in order to change the information in real-time on each of the digital display areas on the sign. In various embodiments, a manual alternative to change the sign with thin plexiglass, magnetic or other inserts may be included.

The solar charging system 110 includes a charger that employs solar energy to supply electricity to devices or batteries. The solar charging system 110 can charge lead-acid, Ni—Cd, and/or LiPo battery banks up to 48 V and hundreds of ampere-hours (over 4000 Ah) capacity. The solar charging system 110 includes solar panels and/or solar cells configured to convert solar energy to a DC voltage, and a battery management circuit configured to manage the charging and discharging of the battery 140.

In various embodiments, the processor may execute instructions causing the system to detect motion, by a motion detector apparatus of a user. In various embodiments, the user may have a user device such as a mobile phone or wireless tablet. The motion detector apparatus may include a camera, a microphone, a speaker, and a button configured to initiate contact with a person associated with a property for sale, by a wireless network. Next, the system may display, by a touch screen display or tablet computing device, an advertisement associated with the property, in response to the detected motion. For example, the user may walk up to the system and in response to the user's motion, the touch screen display may provide the user options, for example, such as 1) virtual tour of the property, 2) wirelessly communicate to the user a weblink with additional information on the property, and/or 3) generate leads (e.g., ask if the user is pre-qualified for a residential mortgage, and/or lead generation for any kind of business). Upon the user selecting the option, the touch screen display would then, for example, either play the virtual tour of the property, send the weblink to the user's device, or send the user a web link to get prequalified. In a case where the user gets prequalified, the system may send them a PDF of the prequalification.

In various embodiments, the user may capture a barcode located on the system using a camera on the user's device. In embodiments, the bar code may be located on the display, on the post 102, and/or on one of the other sections in a suitably visible location. The system may then transmit information associated with the property, based on the barcode, to the user device.

In various embodiments, based on the motion detection, the system may connect for two-way communication, via a wireless network, a person from a predetermined contact list, the person associated with the property. For example, the person associated with the property may be a real estate agent associated with the listing for the property. The real estate agent may, based on the user's prequalification unlock an electronic lock on the property remotely, allowing the user to access the property to tour it.

Figure 2:
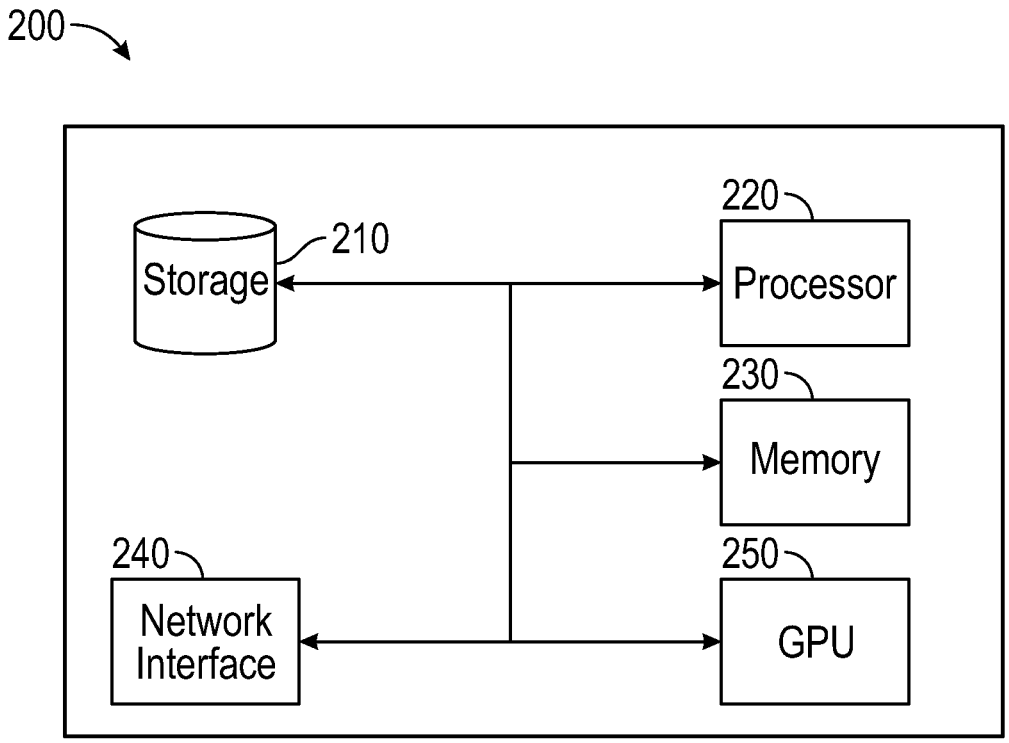
FIG. 2 is a block diagram of a control unit for the interactive display of FIG. 1.
Figure 3:
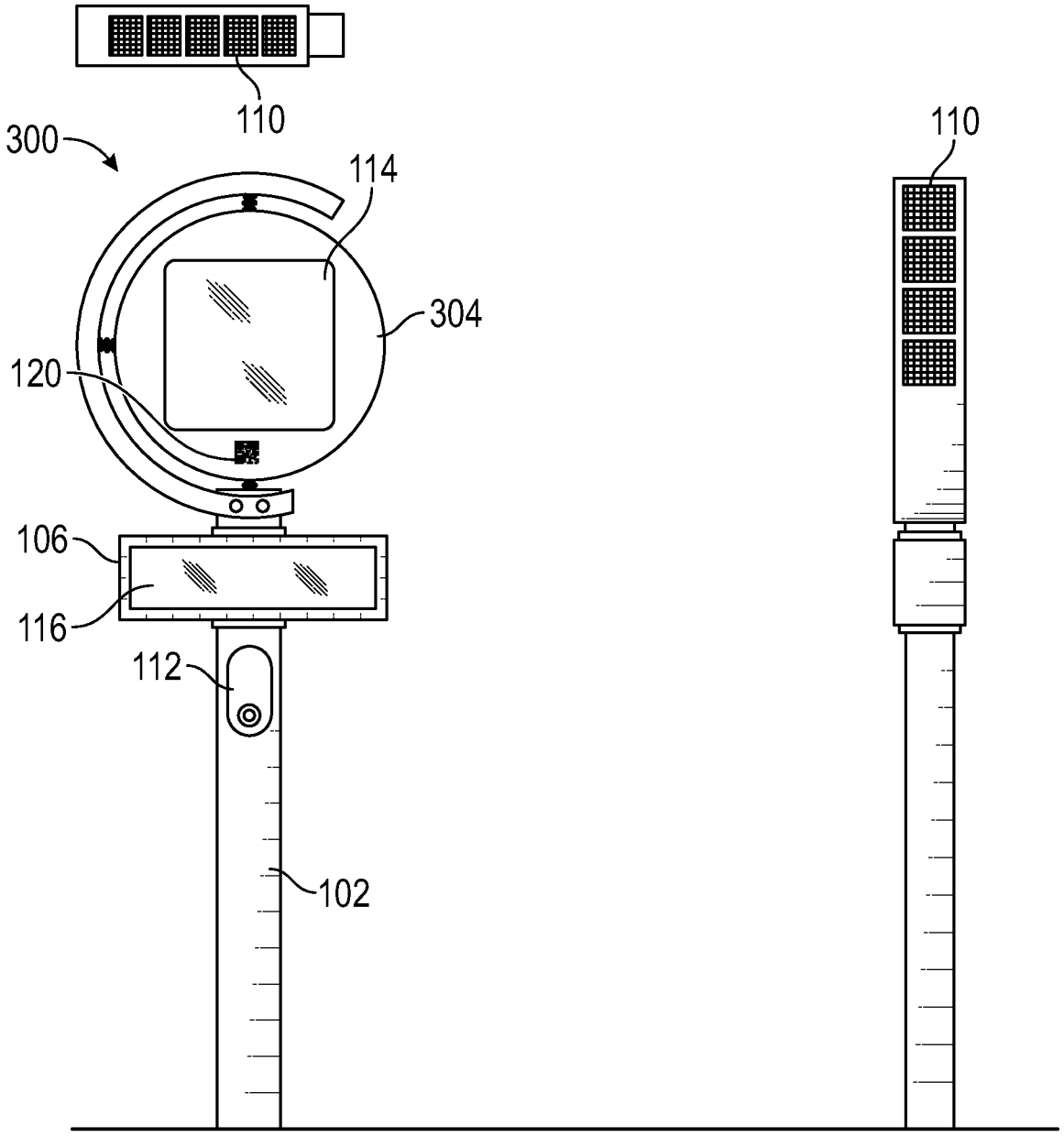
FIGS. 3-6 are side views of other embodiments of the system for interactive display of property advertising, in accordance with the present disclosure.
Figure 4:
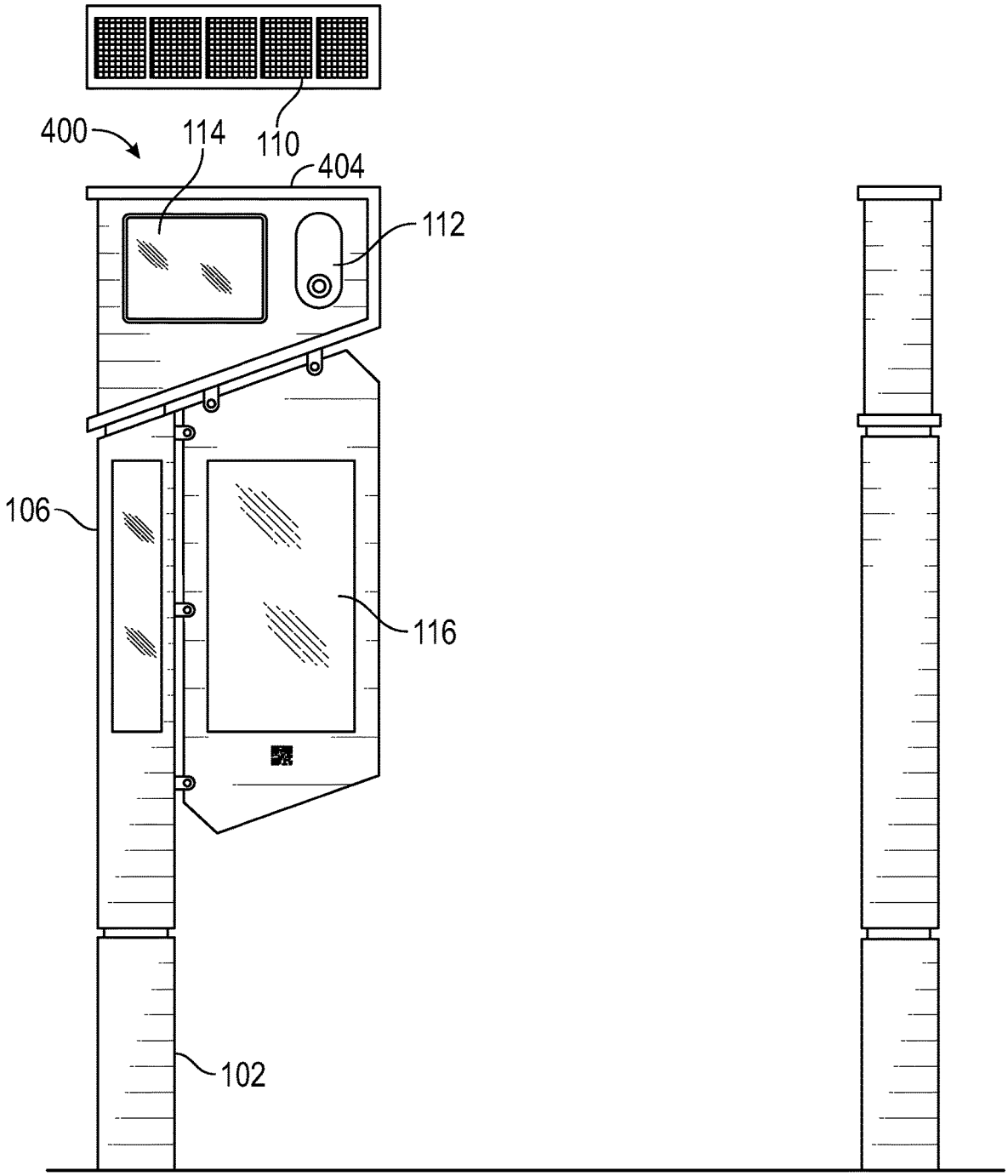
Figure 5:
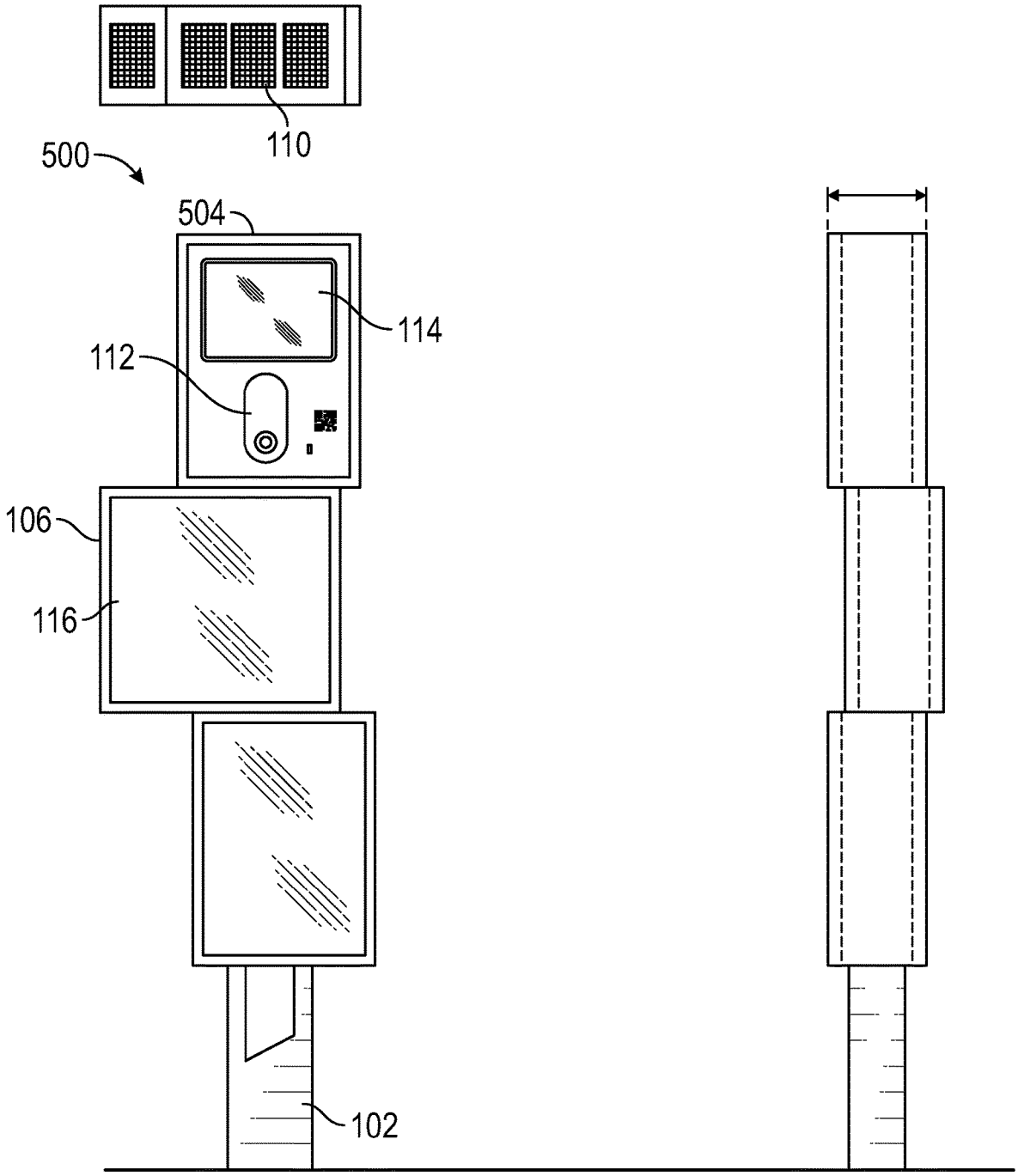
Figure 6:
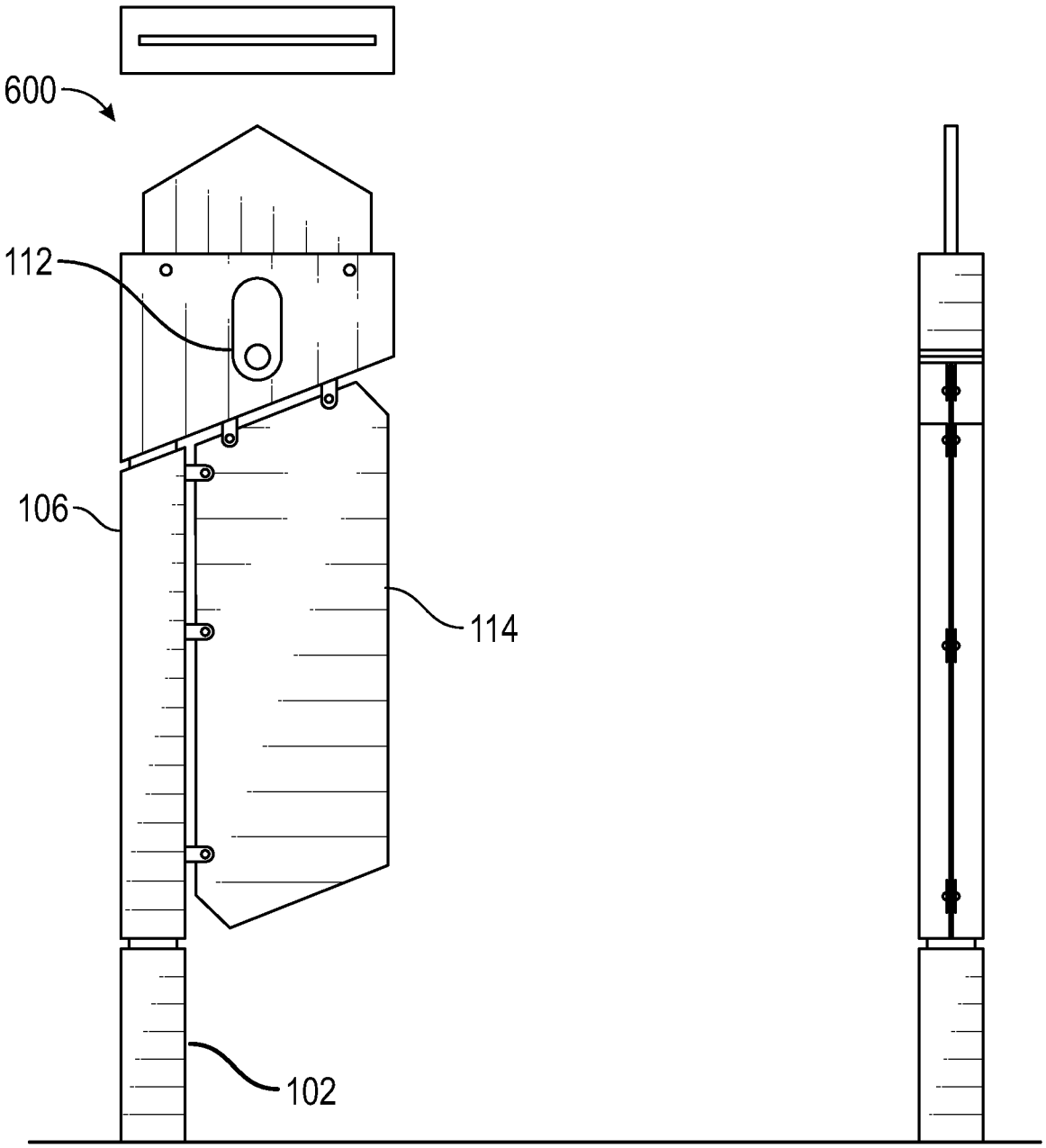

With reference to FIG. 2 a control unit 200 is shown. The control unit 200 includes a processor connected to a computer-readable storage medium or a memory which may be a volatile type memory, such as RAM, or a non-volatile type memory, such as flash media, disk media, or other types of memory. In various embodiments, the processor may be another type of processor such as, without limitation, a digital signal processor, a microprocessor, an ASIC, a graphics processing unit (GPU), field-programmable gate array (FPGA), or a central processing unit (CPU).

In various embodiments, the memory can be random access memory, read-only memory, magnetic disk memory, solid-state memory, optical disc memory, and/or another type of memory. In various embodiments, the memory can be separate from the control unit and can communicate with the processor through communication buses of a circuit board and/or through communication cables such as serial ATA cables or other types of cables. The memory includes computer-readable instructions that are executable by the processor to operate the control unit. In various embodiments, the control unit may include a network interface to communicate with other computers or a server.

With reference to FIGS. 7-12 a ground mounting system 700 for the interactive property advertising system 100 is shown. It is contemplated that this system may be used to mount other systems to the ground (e.g., fence posts, signs, etc.).

Figure 10:
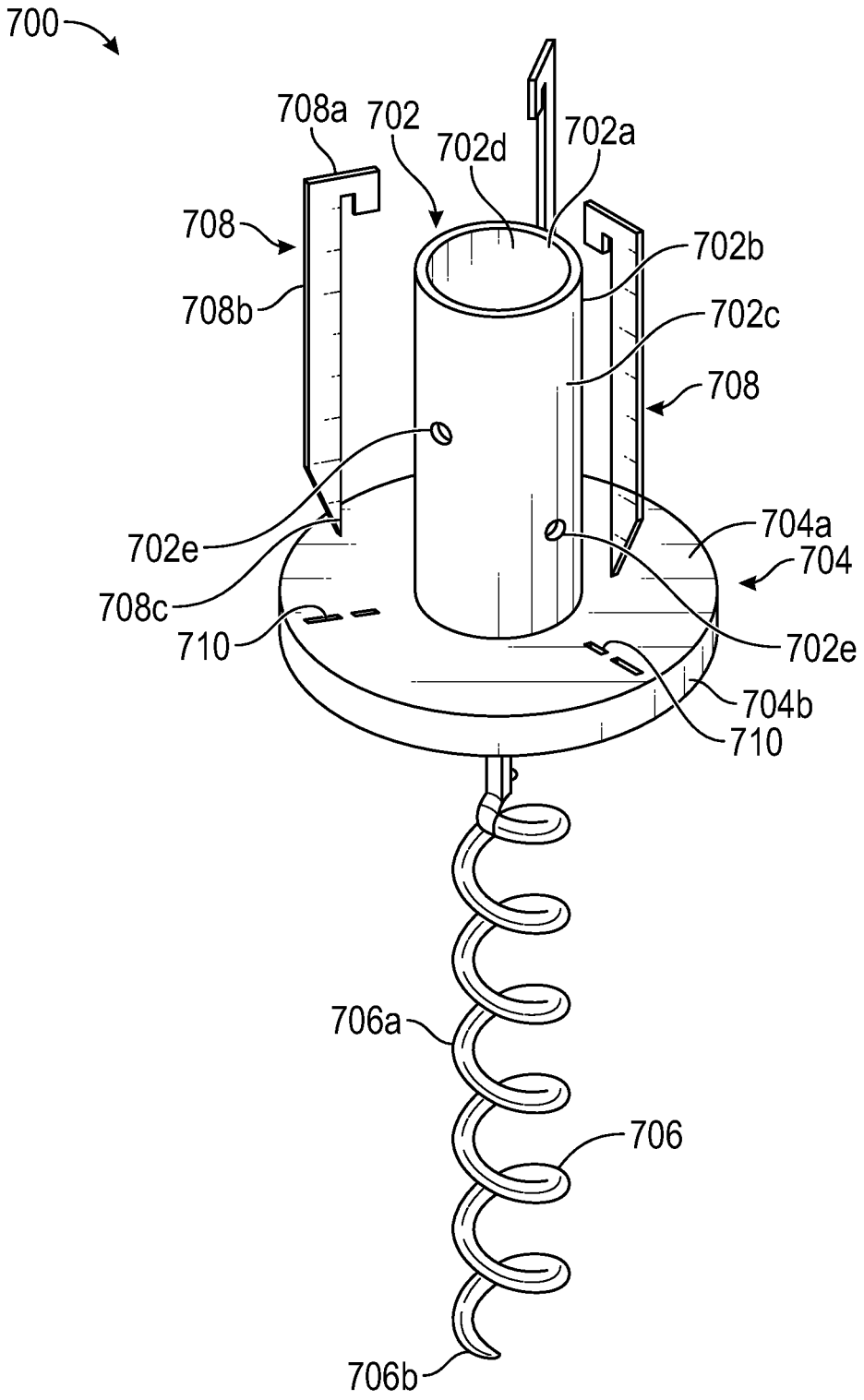
Figure 11:
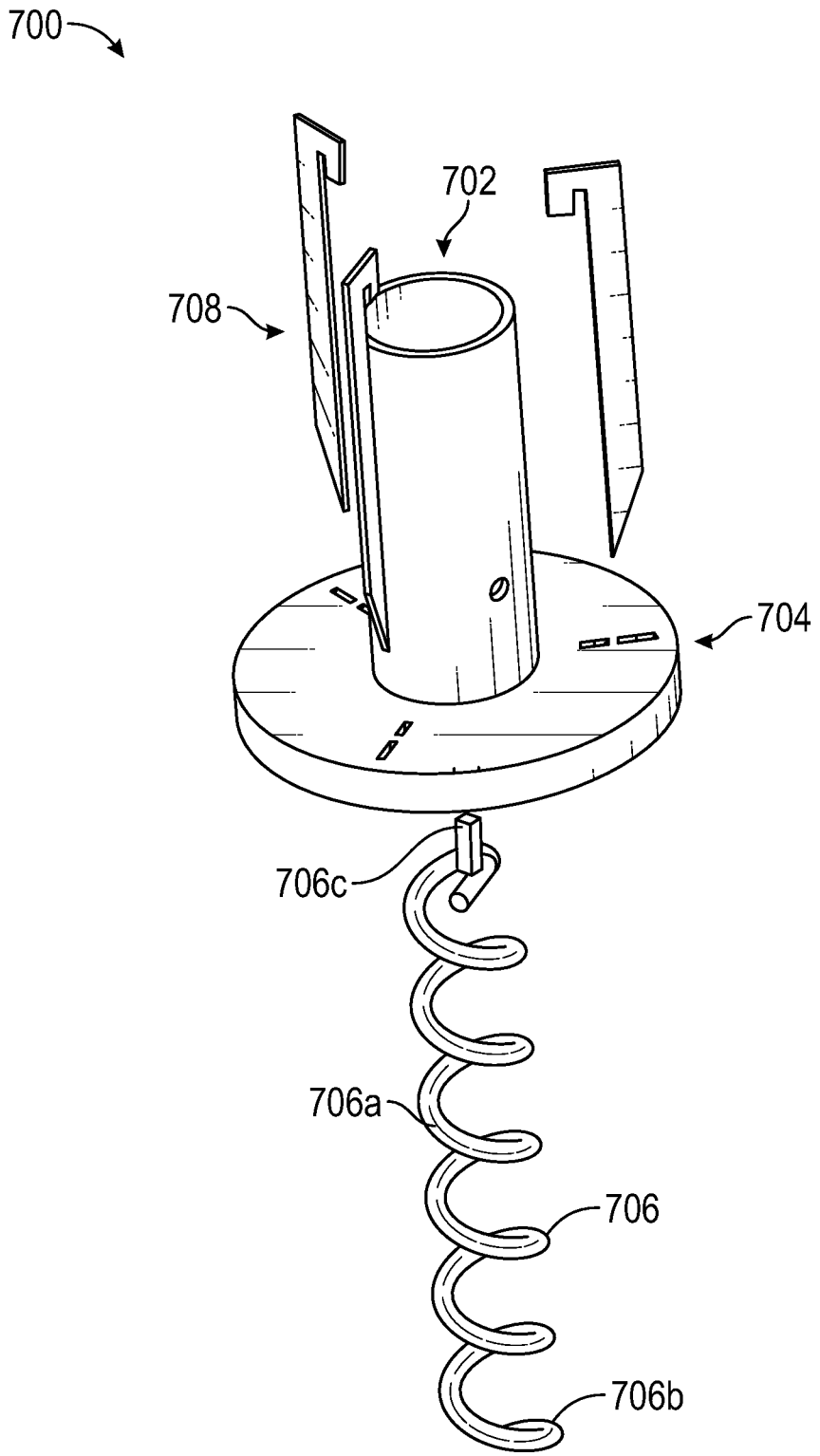
Figure 12:
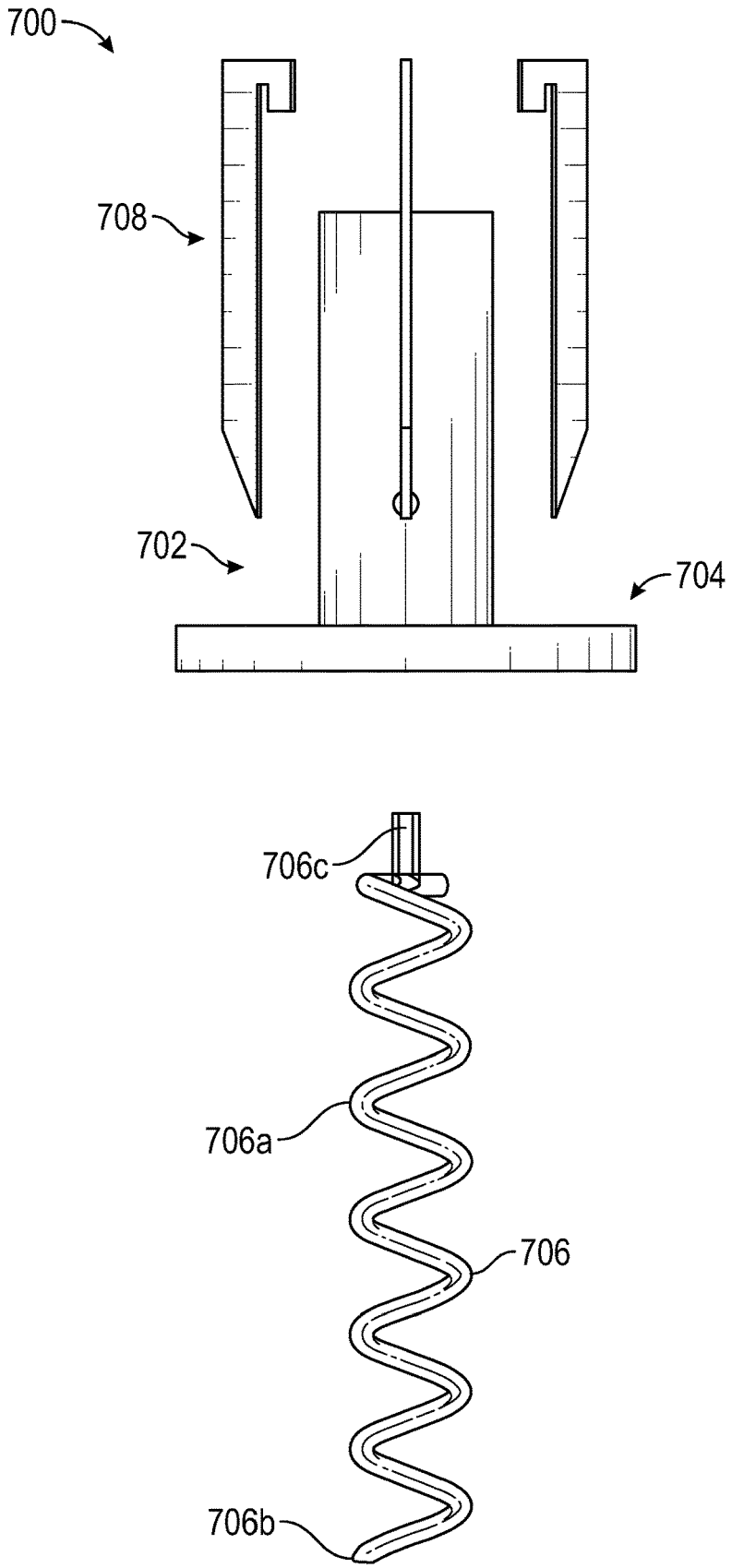

The ground mounting system 700 includes a sleeve 702, a plate 704, an auger 706, and stake(s) 708. The sleeve 702 is configured to support the post 102. The sleeve 702 may be any suitable geometric configuration suitable to support the post 102 (e.g., square, trapezoidal, circular, oblong, rectangular, etc.). In aspects, the sleeve 702 may be configured to receive the post 102, and/or the post 102 may be configured to receive the sleeve 702. The sleeve 702 defines a longitudinal axis. With further reference to FIG. 10, the sleeve 702 includes a proximal portion, a distal portion, an inner surface 702*a*, an outer surface 702*b*, and a sidewall 702*c*. The inner surface defines a central passage therethrough 702*d*. The sidewall 702*c* of the sleeve 702 includes a transverse passage 702*e* that extends therethrough. The transverse passage 702*e* is configured for locking the post 102 to the ground mounting system 700 by inserting a locking mechanism such as, for example, a rod or bolt. The transverse passage 702*e* is configured for receipt of a suitable tool 760 (FIG. 9) for translation of a tangential force in a downward direction to drill the auger 706 into the ground. The distal portion of the sleeve 702 is disposed on a top surface 704*a* of the plate 704. The plate 704 is configured for securing to the sleeve 702.

With continued reference to FIG. 10, the plate 704 includes the top surface 704*a*, a bottom surface (not shown), and a side surface 704*d*. The top surface 704*a* of the plate 704 defines slots 710 that extend longitudinally relative to the central axis and extend through the top surface 704*a* of the plate 704 and are configured for receipt of the stake(s) 708. The slots 710 extend through the plate 704 and are radially spaced apart. It is contemplated that the plate may be any suitable geometric configuration (e.g., round, square, oval, rectangular, etc.)

Figure 13:
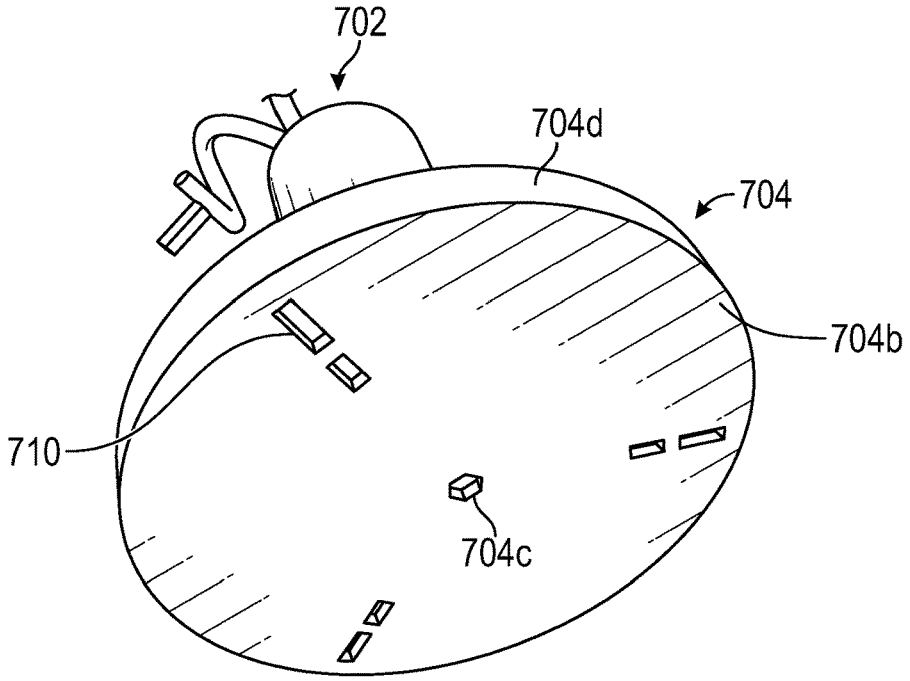
FIG. 13 is a bottom view of the ground mounting apparatus of FIG. 7.

The auger 706 is disposed on the bottom surface 704*b* (FIG. 13) of the plate 704 and is configured for securement to the ground. The auger 706 may be detachably connected to the bottom surface 704*b* of the plate 704 by coupling into a receiving socket 704*c* of the plate 704. It is contemplated that the receiving socket 704*c* (FIG. 13) may include any suitable size or shape including, for example, hexagonal and/or cylindrical. The auger 706 is rigid to facilitate drilling into the ground and for securement to the ground. The auger 706 includes a helical arrangement of coils 706*a*, a pointed tip 706*b* located at the distal end of the auger 706, and a drive member 706*c* disposed on the proximal end of the auger 706. The coils 706*a* extend around a longitudinal axis of the ground mounting system 700 and are disposed in registration with the sleeve 702. As the auger 706 is rotated, it creates a force to displace soil as it anchors the interactive property advertising system 100. It is contemplated that the drive member 706*c* may include any suitable size or shape, including, for example, a nut and/or a cylinder. In aspects, the auger 706 may be driven into the ground by attaching, for example, a standard handheld drill to the drive member 706*c*.

Figure 14:
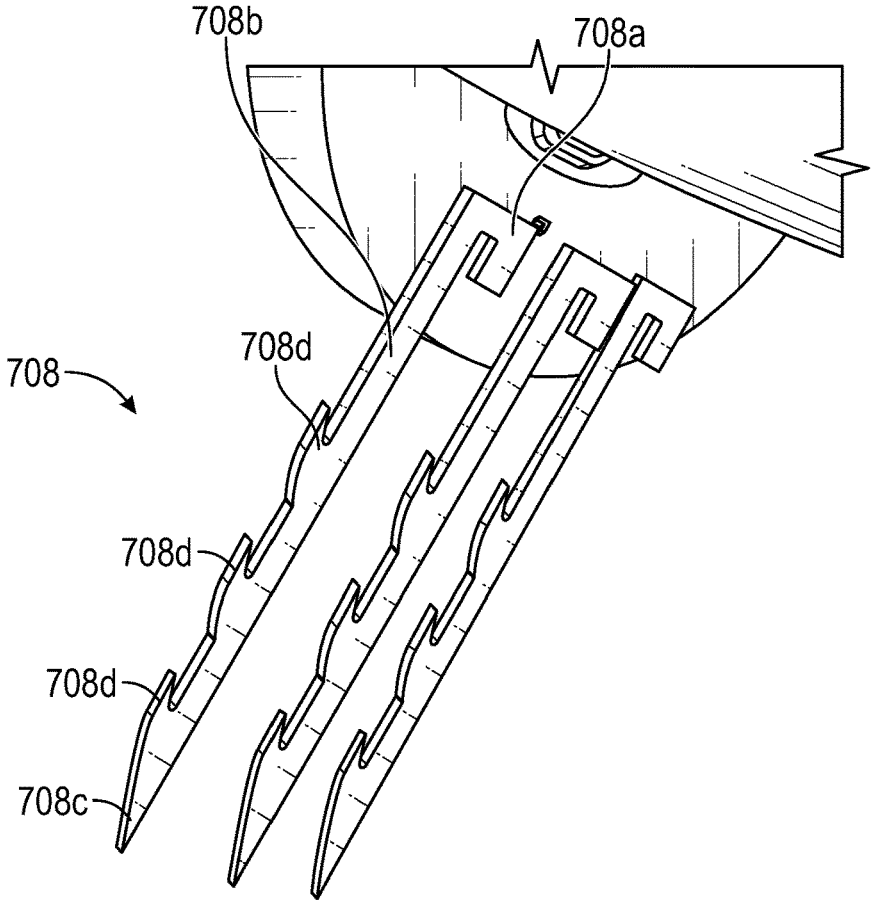
FIG. 14 is a side view of the stake of the ground mounting apparatus of FIG. 7.

The stake(s) 708 are disposed in the slot(s) 710 and are configured for radial support and to further fix the position of the ground mounting system 700 after the auger 706 has been fully driven into the ground. The stake(s) 708 include a retaining finger 708*a* configured to retain the stake 708 in the slot 710 of the plate 704, and a leg 708*b*. The retaining finger 708*a* may include a hook shape configured for retaining the stake within the at least one slot. The leg 708*b* extends to a piercing edge 708*c*. The piercing edge 708*c* is configured to pierce or cut the earth while driving the stake(s) 708 into the earth. The leg 708*b* may include one or more second retaining fingers 708*d* (FIG. 14) configured to help secure the stake 708 in the ground. The stake(s) 708 may be driven into the earth by a mallet or other suitable tool.

In various embodiments, the bottom of the post 102 may include a foot pedal to create the force to drive the auger 706. The torque will be created by a ratcheting system that is attached to the foot pedal. To release, a user would ratchet down a few pumps and then unclamp the floor plate; remove it; and then pull the auger out of the ground. In various embodiments, the ratchet for the auger 706 will be attached to a handheld drill bit that will stick out from the sleeve 702.

Figure 15:
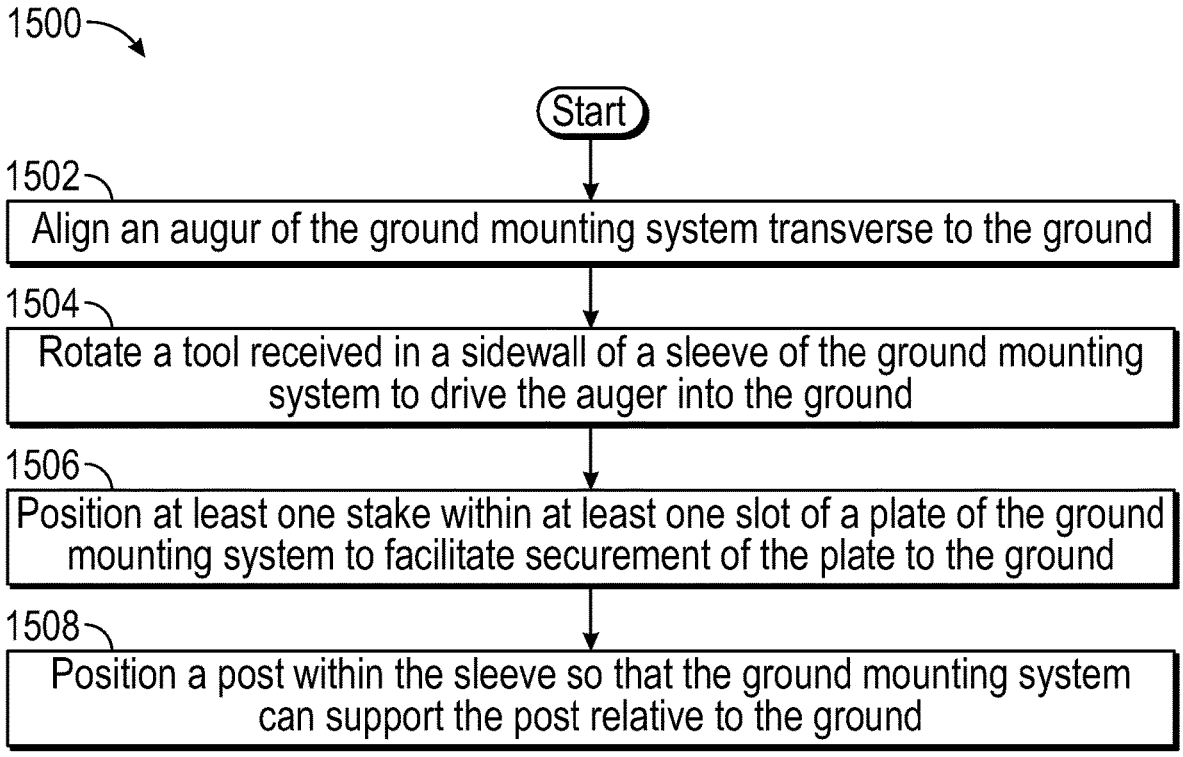
FIG. 15 is a flow diagram for a method for installing a ground mounting system of FIG. 7 into the ground.

FIG. 15 is a flow diagram for a method for installing a ground mounting system of FIG. 7 into the ground. Initially, at step 1502, the method aligns an auger 706 (FIG. 7) of the ground mounting system 700 transverse to the ground. For example, the auger 706 may be oriented perpendicular to the ground.

Next, at step 1504, the method rotates a tool 760 (FIG. 9) received in a sidewall 702*c* of a sleeve 702 of the ground mounting system 700 to drive the auger 706 into the ground. The sidewall 702*c* defines a transverse passage 702*e* (FIG. 10) for receipt of the tool 760. The tool 760 for example, may include a rod.[J1] In aspects, the tool may be removed from the transverse passage 702*e* once the plate 704 is approximately flush with the ground. In aspects, rotating the tool 760 may include rotating in either clockwise or counterclockwise direction relative to the auger 706.

Next, at step 1506, the method positions at least one stake 708 within at least one slot 710 of a plate of the ground mounting system to facilitate securement of the plate to the ground. For example, once the plate 704 is approximately flush to the ground, a user may drive one or more stakes 708 through the slots 710 to secure the ground mounting system 700 to the ground. In aspects, the method may include piercing the ground with a pointed tip(s) of the stake(s) 708. In aspects, the stake(s) 708 may be arranged around the post in a radial arrangement.

Next, at step 1508, the method includes positioning a post (e.g., post 102 of FIG. 1) within the sleeve so that the ground mounting system can support the post relative to the ground. For example, the user may mount a sign such as a system 100 for interactive display of property advertising or any other object that has a post in the sleeve. In aspects, the post may be secured to the sleeve by hardware using the transverse passage 702*e* in the sleeve after the tool 760 is removed, and the post is inserted. In aspects, the tool 760 may be used to secure the post to the sleeve.

Certain embodiments of the present disclosure may include some, all, or none of the above advantages and/or one or more other advantages readily apparent to those skilled in the art from the drawings, descriptions, and claims included herein. Moreover, while specific advantages have been enumerated above, the various embodiments of the present disclosure may include all, some, or none of the enumerated advantages and/or other advantages not specifically enumerated above.

The embodiments disclosed herein are examples of the disclosure and may be embodied in various forms. For instance, although certain embodiments herein are described as separate embodiments, each of the embodiments herein may be combined with one or more of the other embodiments herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in embodiments," "in various embodiments," "in some embodiments," or "in other embodiments" may each refer to one or more of the same or different embodiments in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. A ground mounting system for supporting a post, the ground mounting system comprising:

a sleeve configured to receive the post therein;

a plate secured to the sleeve and defining at least one first slot and at least one second slot therethrough;

an auger positioned to extend from the plate to secure the plate to a ground surface, wherein the auger includes a helical arrangement of a coil including an aperture therein; and at least one stake receivable within the slots to facilitate securement of the plate to the ground surface, wherein the stake includes a retaining finger configured to retain the stake within the at least one first slot, a leg extending from the retaining finger and a piercing edge extending from the leg being configured to pierce or cut soil while driving the stake into the soil, and wherein the retaining finger includes a hook located on a distal end thereof configured to be inserted into the at least one second slot.

2. The ground mounting system of claim 1, wherein the auger includes:

a pointed tip, wherein spacing of the coil is regularly spaced about the auger.

3. The ground mounting system of claim 1, wherein the sleeve includes a sidewall that defines a transverse passage configured for receipt of a tool for turning the ground mounting system to drive the auger into the ground surface.

4. The ground mounting system of claim 1, wherein the auger includes a drive member configured for transferring rotational force to the auger.

5. The ground mounting system of claim 1, wherein the sleeve comprises an inner surface defining a passage therethrough.

6. The ground mounting system of claim 5, wherein the at least one first slot of the plate extends longitudinally relative to the sleeve.

7. A method of installing the ground mounting system of claim 1, comprising:

aligning the auger of the ground mounting system transverse to the ground surface;

rotating a tool received in a sidewall of the sleeve of the ground mounting system to drive the auger into the ground surface;

positioning the at least one stake within the slots of the plate of the ground mounting system to facilitate securement of the plate to the ground surface; and positioning the post within the sleeve so that the ground mounting system supports the post relative to the ground surface.

8. The method of claim 7, further comprising piercing the ground surface with at least one pointed tip of the at least one stake.

9. The method of claim 7, wherein rotating the tool includes rotating at least one of clockwise or counter-clockwise.

10. The method of claim 7, further comprising orienting the sleeve in a perpendicular orientation.

11. The method of claim 7, further comprising positioning a plurality of stakes within a plurality of slots of the plate of the ground mounting system to facilitate securement of the plate to the ground surface.

12. The method of claim 11, further comprising arranging the plurality of stakes around the post in a radial arrangement.

13. The method of claim 7, further comprising removing the tool received in the sidewall before positioning the post within the sleeve.

14. The method of claim 13, further comprising inserting hardware through a transverse passage into the post to fix the post within the sleeve wherein the transverse passage is defined by the sidewall of the sleeve.

* * * * *